United States Patent [19]

Jacobsz

[11] 4,035,135

[45] July 12, 1977

[54] POSTPURGE PILOT BURNER SEQUENCING MEANS

[75] Inventor: Roelof F. Jacobsz, Blaine, Minn.

[73] Assignee: Honeywell Inc., Minneapolis, Minn.

[21] Appl. No.: 655,351

[22] Filed: Feb. 5, 1976

[51] Int. Cl.[2] ..... F23N 5/00

[52] U.S. Cl. ..... 431/29; 431/31

[58] Field of Search ..... 431/78, 30, 31, 51, 431/29, 67, 72, 42, 49, 3, 48, 60

[56] References Cited

U.S. PATENT DOCUMENTS

| | | | |
|---|---|---|---|
| 2,085,195 | 6/1937 | Kerr | 431/45 |
| 2,818,110 | 12/1957 | Rulseh | 431/29 |
| 2,903,052 | 9/1959 | Aubert | 431/31 |
| 3,026,867 | 3/1962 | Size | 431/43 X |
| 3,082,813 | 3/1963 | Hamelink | 431/31 X |
| 3,449,055 | 6/1969 | Blackett | 431/46 X |
| 3,574,495 | 4/1971 | Landis | 431/31 X |
| 3,814,569 | 6/1974 | Jacobsz | 431/29 |

*Primary Examiner*—William F. O'Dea
*Assistant Examiner*—Larry Jones
*Attorney, Agent, or Firm*—Alfred N. Feldman

[57] ABSTRACT

A fuel burner sequencing device is disclosed which utulizes cam operated switches in conjunction with relays to program the initiation and safe operation of a fuel burner. The sequencing device or means provides for a normal start up and ignition of a fuel burner, and then provides for a postpurge pilot operation for a normal shutdown of the burner. The postpurge pilot operation activates the pilot burner during the time the main burner is on thereby lighting the pilot burner before the main burner is turned off. The pilot burner is retained in a burning state for a short period after the main burner has been turned off to burn off any residual fuel before the sequencing device or means completes its sequence and is ready for the initiation of a new operating cycle.

7 Claims, 2 Drawing Figures

POSTPURGE PILOT BURNER SEQUENCING MEANS

BACKGROUND OF THE INVENTION

In the operation of industrial fuel burners, particularly burners which are used in operations such as food processing, textile processing and other similar types of processing operations it is desirable that all of the fuel entering the combustion chamber be burned off at the shutdown of the burner sequence to avoid the vaporization of unburnt fuels which might contaminate the product being heated by the burner. Many food processing plants and similar processing installations having for many years used natural gas as a fuel for their burners, and no great problem was involved in the shutdown of the burners as the natural gas left little residual product at the shutdown of the main burner. Since the advent of the fuel shortage problems in the world, many of the industrial process burners have been operated on fuel oil as opposed to natural gas. When these burners are operated with fuel oil, the fuel line between the main fuel valve and the burner contains residual oil that can flow to the burner after the burner has been turned off. This fuel than vaporizes, due to the heat within the combustion chamber, and the vaporized fuel causes two types of problems. The first problem is in contamination of the material being processed by the burner, while the second problem is the carbonization of the fuel at the burner nozzle thereby building up carbon deposits that required excessive maintenance to keep the burners in good operating condition.

The recognition of this problem occurred when the burners were switched from natural gas to fuel oil as a source of fuel. In many processing installations the operation of the burners have been manually operated at shutdown to insure that little or no fuel is injected into the hot combustion chamber and thus can be vaporized to contaminate the processed goods or build up as carbon at the burner nozzle. The manual operation of burners is a very impractical and expensive mode of control. This mode of control also does not take into consideration inadvertent losses of flame and unexpected shutdowns that occur.

In the manual operation of this type of burner, the fuel line to the main burner is normally purged of its remaining fuel by the addition of an air pressure to the fuel line while the pilot burner for the device was kept operating on natural gas. The residual oil is purged to the burner and than is burnt off by the operation of the pilot which would than be manually turned off. It can be seen that inadvertent failures, or the inattention of the operator could cause malfunctions in the shutdown of the burner which could destroy or contaminate batches of processed goods.

In order to overcome this problem, some burner operations have been sequenced by a number of time delay relays which would simulate the manual shutdown function, but these arrangements have not been practical due to the cost, complexity, and inability of the systems to provide for abnormal contingencies in the shutdown sequence of burners of this type.

SUMMARY OF THE INVENTION

The present invention is directed to the use of a motor driven cam switching arrangement combined with relays to form a fuel burner sequencing device or means which automatically responds to a process controller or thermostat to initiate a prepurge, normal ignition, and operation of the main valve of the burner. The present invention further provides for the necessary cam operated switches and relays, interconnected with a flame sensor and amplifier means, to provide an automatic burnoff of fuel purged during the shutdown or postpurge period. The present invention also provides this same postpurge pilot function during the main valve operation in the normal portion of the burner sequence to protect against inadvertent operation of the controller, or an inadvertent failure so that the present inventive postpurge pilot arrangement is effective a few seconds after the main fuel valve has been opened to admit fuel whether or not it is during the normal operation of the burner or as a normal postpurge pilot burnoff of residual fuel.

DESCRIPTION OF THE PREFERRED EMBODIMENT

Figure 1:
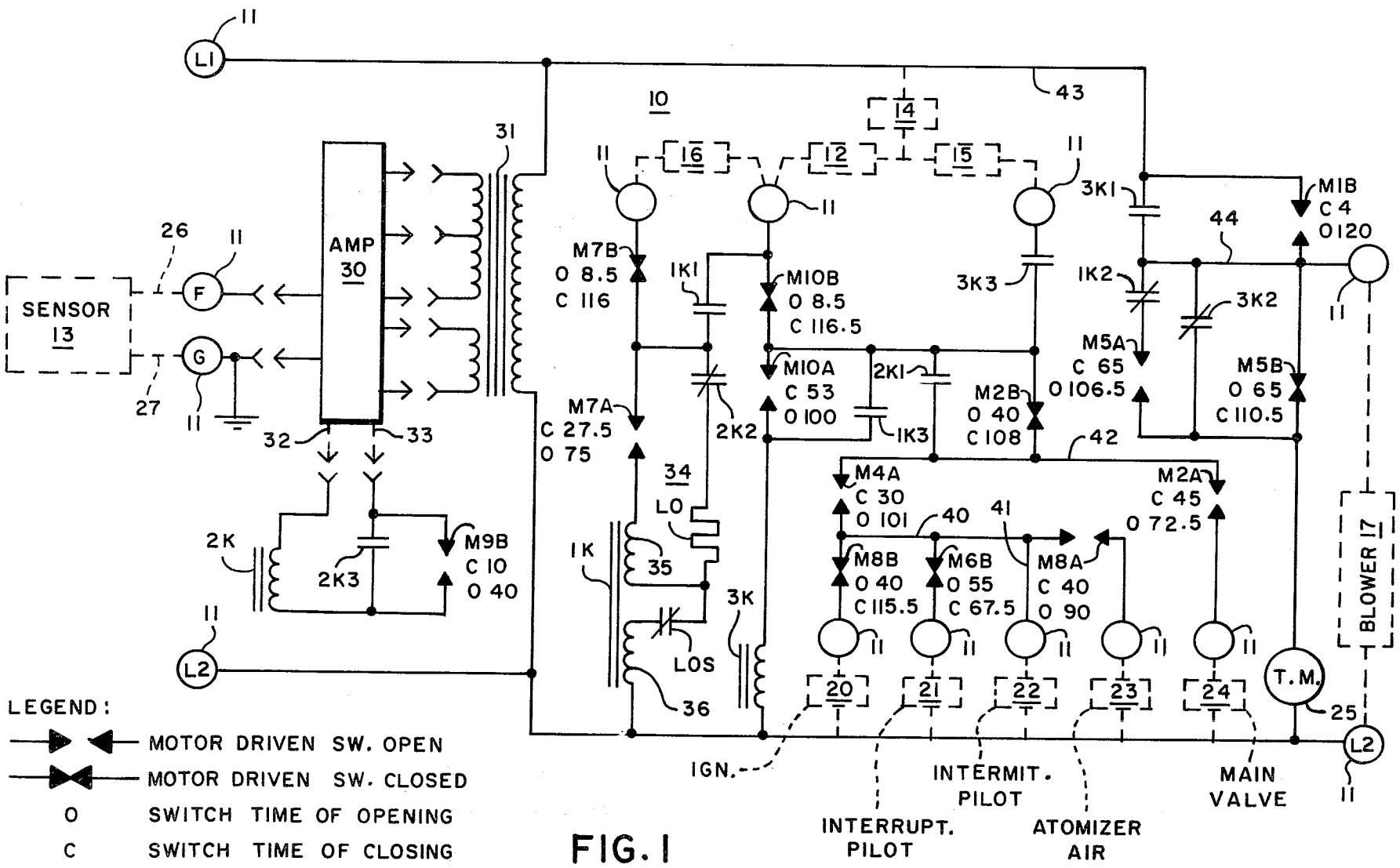
FIG. 1 is a complete schematic diagram of a motor driven cam operated switch and relay programmer utilizing a flame sensor and amplifier means to control a burner.

In FIG. 1 a fuel burner sequencing means 10 is disclosed and this fuel burner sequencing means is adapted to control a fuel burner (some components of which are shown in phantom) in response to a controller or thermostat 12. The fuel burner sequencing means 10 has a plurality of terminals 11 that allow the sequencing means to be connected to the fuel burner, and electric power at terminals L1 and L2. A flame sensor 13 is connected to the F and G terminals of the fuel burner sequencing means 10.

The input power terminal L1 is connected to a conventional limit 14. The limit 14 is an over-temperature, over-pressure, or similar type of safety limit associated with a conventional fuel burner. The limit 14 is connected to the controller 12 and to an air flow switch 15. The air flow switch 15 senses the operation of the blower air for the fuel burner. The controller 12 is further connected to start interlock means 16 which also are common to conventional fuel burners. The start interlock means 16 includes such items as proof of fuel valve closure switches which sense the closed position of the fuel valve at every start up and similar types of functions.

The fuel burner sequencing means 10 further has a terminal 11 that connect the fuel burner sequencing means 10 to a conventional blower 17 which supplies the air flow for burning the fuel in the fuel burner. This blower also provides the prepurge and postpurge air flow through the burner when the burner is not actually burning fuel.

The fuel burner further includes an ignition means 20 which normally would be an ignition transformer, and a pilot valve 21 or 22 for an interrupted type of pilot operation or an intermittent type of pilot operation depending on the needs of the particular fuel burner. The pilot valve 21 is used to the exclusive of pilot valve 22 and vice versa. Both have been shown as a means of explaining how either an interrupted pilot sequence or an intermittent pilot sequence would be accomplished by the present fuel burner sequencing means 10. An atomizer air source 23 is disclosed and its function will be explained along with the operation of the burner. The atomizer air means 23 is a source of air pressure that is controlled by a valve and is used to purge fuel during a postpurge pilot period of operation of the fuel burner so that fuel does not contaminate the process for which the fuel burner is used. A main fuel valve 24 is disclosed and basically completes the external equipment controlled by the fuel burner sequencing means 10 when the fuel burner operates in response to the controller or thermostat 12 in a normal burner sequence.

The fuel burner sequencing means 10 basically is made using a motor operated cam controlled switch means which includes a timer motor 25 and a plurality of cams which operate switch means that has been designated by the term M followed by a numeral to indicate the particular cam operated switch, and a letter designation of A or B to indicate one or the other of two switch contacts. The legend of FIG. 1 shows the motor driven cam operated switches in their open and closed position along with the time of opening and closing so that the sequence can be more readily understood. The detailed description of the circuit for the fuel burner sequencing means 10 will identify the cam operated switch means and their basic function. The fuel burner sequencing means 10 further includes relay operated switch means that include three relays each having conventionally shown normally open and normally closed contacts and the relays will be identified along with their contacts with a conventional designation.

The flame sensor 13 can be of any type such as a flame rod, an ultraviolet sensor, or a photocell. The sensor 13 is connected by conductors 26 and 27 to the F (flame) and G (ground) terminals 11 of the fuel burner sequencing means 10.

The fuel burner sequencing means 10 includes an electronic amplifier means 30 that is of a plug-in type. The amplifier means 30 has a number of input and output conductors that are attached to terminals that allow the amplifier means 30 to be plugged into the sequencing means 10 and the amplifier 30 is selected to be compatible with the particular sensor 13. This arrangement provides for complete flexability between different types of amplifiers and sensors for use with the same basic sequencer to practice the present invention. For simplicity sake the details of the plug-in arrangement and conductors will not be enumerated as they are well-known in the art and would merely add unnecessary complexity to the present disclosure. It is enough to indicate that amplifier means 30 is supplied with electric power from a transformer 31 that is connected between the power lines L1 and L2 and have connections to the terminals F and G for an input signal from the sensor 13. The amplifier means 30 has an output on conductors 32 and 33 to energize a flame relay designated as the 2K relay for the present device. The flame relay 2K has a normally open contact 2K3 which locks in the flame relay 2K upon the operation of a cam operated switch M9B which closes at ten seconds into the operation of the device and opens at forty seconds into the operation of the device. It is thus apparent that at any time between the ten second and forty second points of operation that the 2K relay can be energized from the amplifier means 30 and locks itself in by the normally open contact 2K3. This explanation merely identifies the type of legend and notion that will be used in the balance of the circuitry and in the subsequent detailed table which discloses the operation in a step-by-step manner.

The start interlock means 16 is connected through terminal 11 to a cam switch M7B that in turn is connected to a control circuit means 34 which includes a control relay 1K which has two windings 35 and 36. The two relay windings 35 and 36 are used for a safe start operation that will be briefly described in connection with the present device and is commonly used in fuel burner sequencing means of this general type.

Relay winding 35 is connected to the cam operated switch M7B through an initially open contact M7A and through a lockout switch heater LO and a normally closed contact 2K2 of the flame relay 2K back through a normally opened relay contact 1K1 of the control relay 1K to the terminal 11 where the start interlock means 16 and the controller or thermostat 12 connect. The lockout switch heater LO is thermally activated and interconnected to a safety switch or lockout switch LOS that is normally closed and connected through the winding 36 to the line L2. The 1K relay and the lockout switch LO act as a safety function to shutdown or turn-off the fuel burner and are sometimes referred to as the safety switch for a fuel burner sequencing means. The normally closed switch LOS mechanically latches itself into an open position if the lockout switch heater LO activates the switch LOS, and a manual reset of the device is necessary thereby bringing to the attention of maintenance personnel the need for maintenance due to a failure in the system. This safety lockout means LO and its operation are well known in the fuel burner sequencing art.

The limits 14 supply power through the controller or thermostat 12 to a terminal 11 and a closed switch M10B is used to supply electric power through the switch M10A to a load relay 3K. The cam operated switch M10A is paralleled by a normally open 1K3 contact of the 1K relay and the load relay 3K is normally energized upon the operation of the 1K relay when the 1K3 contact closes.

The flame relay 2K has a contact 2K1 connected to the cam operated switch M10B to provide energy to the burner operated components 20 through 24 after flame has been sensed and the flame relay 2K has operated. The 2K1 contact is paralleled by a cam operated contact M2B which insures that once the flame operated relay 2K operates, that power is continuously supplied providing the operation of the device is normal.

The blower 17 of the fuel burner, when operating, closes the air flow switch 15 which supplied electric power through the terminal 11 and a relay contact 3K3 which operates in response to the load relay 3K. The load relay 3K has been identified as a load relay because of the power carrying capability of the 3K3 contact which supplies electric power to the burner components 20 through 24. This is accomplished through the M2B cam operated switch, or the flame contact 2K1 and a cam operated switch M4A to the conductor 40. The conductor 40 distributes power to the cam operated switch M8B which in turn supplies power to the ignition means 20, through the cam operated switch M6B to the interrupted pilot 21, or through the conductor 41 to the intermittent pilot 22. It should be understood that in a normal burner either an interrupted pilot 21 will be used, or an intermittent pilot 22 will be used, but only one of these pilot modes is used in any one burner at any one time. They have both been disclosed since interrupted pilots and intermittent pilots are used widely and the particular installation will depend on the individual burner involved.

The conductor 40 further is connected through a cam operated switch M8A to a valve 23 which has been referenced as an atomizer air means. In the present fuel burner, a source of atomizing air is provided to purge the oil burner fuel line of fuel so that it can be burnt off to leave no residual fuel in the hot burner chamber to be vaporized and thereby contaminate the process being heated. The use of atomizer air 23 is common in certain types of fuel burners.

A conductor 42 connects the cam operated switch M2B to a further cam operated switch M2A which in turn is connected through terminal 11 to the main fuel valve means 24 of the device. The line terminal L1 is connected through a conductor 43 (to which the limit 14 is connected) and conductor 43 also supplies power to the terminal M1B which is connected to the blower 17 when the switch M1B closes. This is the basic input power for the blower circuit and further includes an input circuit through the relay contact 3K1 and the conductor 44 through a cam operated switch M5B to the timer motor 25. The timer motor 25 is a smaller clock type motor that drives the plurality of individual cams which in turn operate the various switch means associated with each of the cams as has been described.

The circuit is completed by the control relay contact 1K2, which is normally closed, and supplies power through a cam operated switch M5A to the time motor under certain circumstances. The conductor 44 is also connected through a contact 3K2, which is a normally closed load relay contact, to the timer motor 25 so that the timer motor can obtain power under the various operating modes to sequence the fuel burner sequencing means 10, as will be detailed in connection with the table that supplies the detailed operating sequence for all of the components of the cam operated switch means and the relay means in a normal burner operation.

Figure 2:
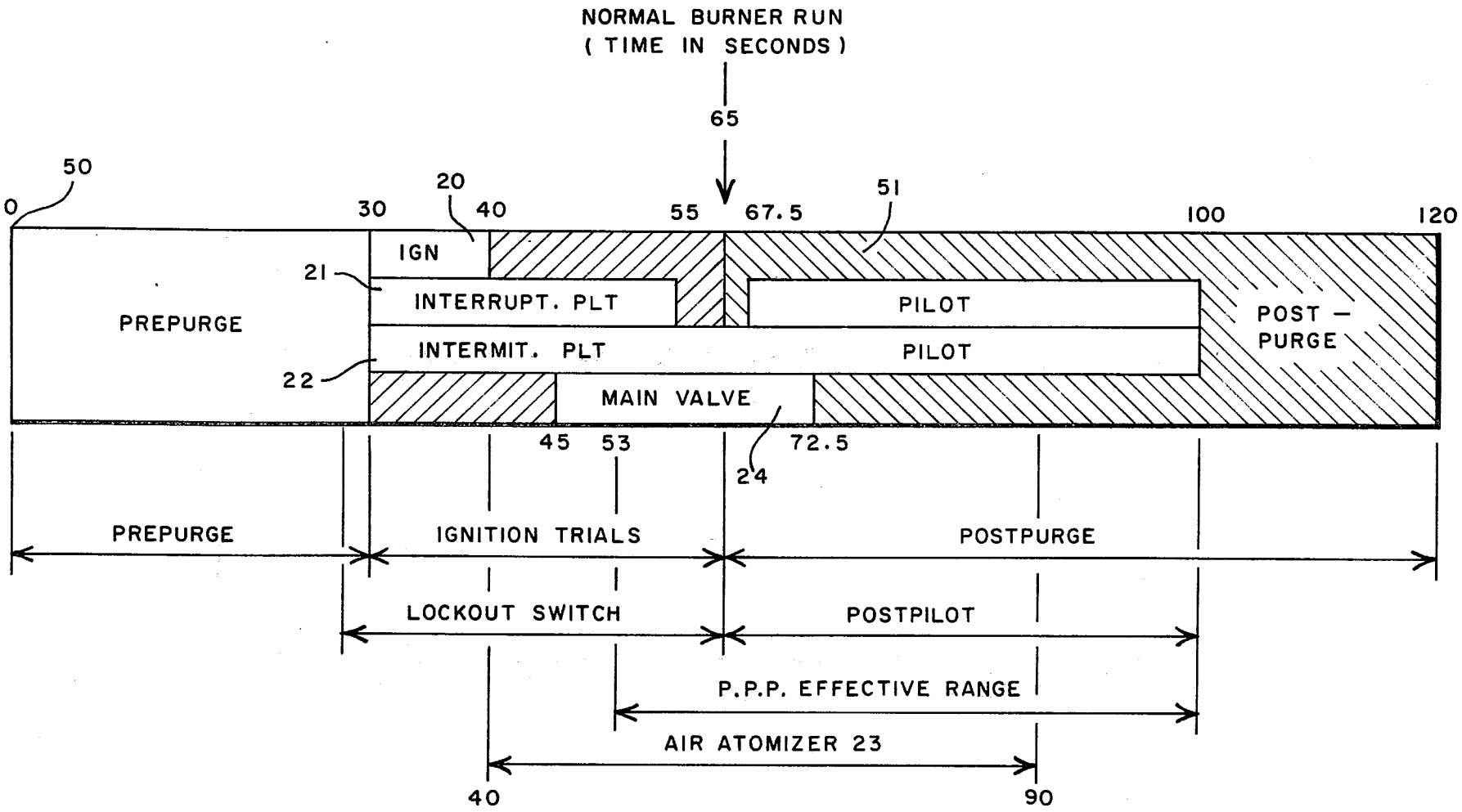
FIG. 2 is a bar chart showing the operation of the burner control device through its entire normal cycle.

The normal operating sequence will be described by means of a chart after reference to the general operating characteristics of the burner is disclosed in FIG. 2 in the form of a bar chart. In FIG. 2 a bar chart showing the function versus time of a normal burner run is disclosed, along with the effective ranges (in seconds) of the various normal functions and the invention of the present application.

In the bar chart time zero is designated at 50 wherein a prepurge time is undertaken for 30 seconds to clear the fuel burner of any unburnt fuel and combustion products for safe startup of the burner. At the 30 second point, the ignition 20 is energized and either the interrupted pilot 21 or the intermittent pilot 22 is energized. One or the other of these would be used but the bar chart shows both for comparison sake only. Assuming that the device disclosed in FIG. 1 has a connection to an interrupted pilot 21 only, the sequence will be followed and it is believed that the sequence of the intermittent pilot 22 will also be understood.

The ignition 20 and the interrupted pilot 21 are energized at the 30 second interval and 10 seconds are allowed for the ignition transformer or means 20 to ignite the fuel from the interrupted pilot 21. During this time, it is normal for the pilot flame to be established and become stable, and at 40 seconds the ignition means 20 is deenergized to turn off the ignition. The pilot burner is sensed by the sensor 13 and the amplifier 30 to provide for a safe start for the device. As soon as the ignition means 20 is energized at 30 seconds, the sensor 13 becomes active and at this point in time the lockout switch heater circuit 34 has been energized to start timing out a safe start period for the system. It is assumed that the pilot light will have ignited by the 40 second interval, and at 45 seconds the cam operated switch M2A is closed to energize the main valve 24. The main valve fuel is ignited from the pilot 21 and at 55 seconds the interrupted pilot 21 is deenergized leaving the main valve 24 open and the fuel burning. When the sequencer reaches the 65 second point it time, the sequencing circuit is opened by contact M5B so that the burner operates in response to the controller 12.

The normal burner run time can be anything from a few minutes to hours depending on the need for the operation of the burner. As soon as the controller 12 opens, the postpurge period 51 is initiated. The cam operated switches operate at 67½ seconds to energize the interrupted pilot 21 while the main valve 24 is still open and a main burner flame is still present. The fuel issuing from the burner with the main valve 24 open ignites the pilot 21 and then at 72.5 seconds into the operating bar chart time, the main valve 24 is closed by the contact M2A opening. During all of this time, the atomizer air 23 is present and the atomizer air is available to force the fuel in the main valve burner line from the line to the burner out into the pilot where the fuel is burnt off in a clean manner rather than being allowed to enter a hot fuel burner chamber and vaporizing to contaminate the process being controlled. This type of operation is unique and is different than the conventional burner where the pilot is not brought on again after its initial deenergization and the operation of the main valve 24.

The pilot is allowed to burn until 100 seconds at which time the postpurge period is for all practical purposes completed. If it is desired, the time from 100 seconds into the burner operation of the sequence to the 120 second interval can be used for postpurge air flow of the burner, but this is not necessary and merely is provided if it is desired in a particular burner. The postpurge period can be considered as terminating at 100 seconds when the device would shut down completely and be prepared to recycle.

The postpurge pilot operation of the present invention is operative for a range of time greater than the actual postpurge period that would normally be expected from the 65 second interval. The postpurge pilot effective range begins at 53 seconds into the operation of the bar chart and is accomplished by the motor driven cam and relay operation so that the postpurge pilot function can be available in the event that the controller 12 opens before the device reaches the 65 second interval or if there is some other type of interruption of the sequence. The postpurge pilot effective range has been selected from the 53 second point to allow for the build up of normal construction tolerances in the cam operated switch mechanism. In an ideal and perfect device, the postpurge period effective range would be effective simultaneously to the opening of the main valve 24 which would be 45 seconds. As indicated as a practical matter, it is very difficult to eliminate the buildup of tolerances in the cam operated switch means and therefore an 8 second delay from the opening of the main valve 24 to the instituting of the postpurge pilot effective range has been shown. This 8 second delay is a matter of practical convenience rather than part of the invention in the operation of the device 10. It is desirable to have the postpurge pilot effective range effective as soon after the main valve 24 opens as possible to accommodate any unexpected or undesirable interruption of the main valve fuel thereby allowing the pilot to burn off the fuel in the line between the main valve and the burner. In a normal cycle of the postpurge pilot effective range operation, it is necessary that upon the postpurge pilot range becoming effective that the lockout switch sequence be deactivated so that the device does not inadvertently lockout without burning off the residual fuel. The device 10, after it burns off the residual fuel, cycles to the zero time so that the system can be restarted by the controller 12 and does not automatically lockout on the lockout switch LOS operation except in the event of a flame failure. It thus becomes imperative for the present invention that the lockout switch LOS be deactivated whenever the postpurge pilot effective range becomes active upon the opening of the controller 12 either prior to the normal burn run time or at the normal shutdown of the burner after the 65 second point in time. This will be brought out in more detail in connection with the following chart which discloses the operation of the device in a second-by-second, step-by-step manner.

The diagram of FIG. 1 shows all of the motor driven timer contacts at the zero start position of operation of the cycle and with all of the relays 1k, 2K and 3K in the dropped out state along with the operating controller or thermostat 12 in an open or stand-by mode. All of the relay contacts are in the position shown in the drawing at the zero start, as are all of the motor driven switch contacts. The contact M1B has just opened and all of the relays have become deenergized along with the turning off of the blower 17. At this point in time, the time interval is considered zero and the following chart enumerates the function in a step-by-step manner.

TABLE OF NORMAL OPERATION

| TIME (SEC.) | TIMER CONTACT FUNCTION | ACTION OR CONDITION |
|---|---|---|
| 0 | Operating Controller 12 closes calling for heat | When the limits 14 and start interlocks 16 are closed, the 1K relay pulls in energizing relay 3K. Relay 3K pulls in energizing the burner motor or blower 17 and the timer motor 25. |
| 4 | M1B Closes | Assures that the timer motor 25 returns to the zero start position. |
| 8.5 | M7B Opens | Prevents relays 1K and 3K from pulling in beyond this point in time. |
| | M10B Opens | Prevents relay 3K from pulling in beyond this point in time. |
| 10 | M9B Closes | Allows relay 2K to pull in upon flame being sensed. |
| 27.5 | M7A Closes | Activates lockout switch circuit 34. The lockout switch LO is energized until flame has been detected and contact 2K2 opens. |
| 30 | M4A Closes | Energizes the ignition means 20 and the pilot valve 21 or 22. Terminates the prepurge and starts the ignition trails. |
| 40 | M2B Opens | Flame must be proved at this time with 2K1 closed or lockout switch LOS will open. Terminates pilot flame establishing period. |
| | M8B Opens | Deenergizes the ignition means 20 terminating the pilot flame ignition trial. |
| | M8A Closes | Energizes the air atomizer means 23. |
| 40 | M9B Opens | Prevents relay 2K from pulling in beyond this point in time. The relay 2K must be pulled in at this time and sustain itself by sensing the presence of flame or shutdown and lockout will occur. |
| 45 | M2A Closes | Energizes the main fuel valve 24, starting the main flame ignition trial. |
| 53 | M10A Closes | Activates postpurge pilot effective range circuit. |
| 55 | M6B Opens | Deenergizes the interrupted pilot 21 (when used), terminates the 10 second main flame ignition trial. |
| 65 | M5A Closes | Allows the timer motor 25 to restart when relay 1K drops out. |
| | M5B Opens | Stops the timer motor 25 in the normal burner run period. The 1K or 3K relays must drop out to restart the timer motor 25. |
| 65+ | Operating Controller 12 opens | The relay 1K drops out energizing the timer motor 25 through M1B, 1K2, M5A. Loads 22, 23 and 24 remain energized. |
| 67.5 | M6B Closes | Energizes the postpurge pilot valve 21 allowing the main flame to light-off the postpurge pilot (starts postpurge pilot flame ignition trial). |
| 72.5 | M2A Opens | Deenergizes the main fuel valve 24 and terminates the postpurge pilot flame ignition trial. |
| 75 | M7A Opens | Prepares relay 1K pull-in circuit. |
| 90 | M8A Opens | Deenergizes the air atomizer means 23. |
| 100 | M10A Opens | Deenergizes relay 3K. Relay 3K drops out deenergizing the postpurge pilot valve 21 or 22. |
| 101 | M4A Opens | Resets the load circuits at 20, 21, 22 and 23 for next cycle. |
| 106.5 | M5A Opens | Checks that relay 3K has dropped out. Timer motor 25 remains energized through contact 3K2 only. The sequencer 10 will "hang-up" at this point in time if contact 3K2 is open. |
| 108 | M2B Closes | Reset for next cycle. |
| 110.5 | H5B Closes | Reset for next cycle. Bypasses contact 3K2. |
| 115.5 | M8B Closes | Resets ignition means 20 circuit for next cycle. |
| 116 | M7B Closes | Allows relay 1K to pull in for next cycle start up. |
| 116.5 | M10B Closes | Allows relay 3K to pull in for next cycle start up. |
| 0/120 | M1B Opens | Stops the timer motor 25 in the zero start position. |

ABNORMAL OPERATION

In the event of a momentary power failure, the relays 1k and 3K drop out immediately causing an immediate shutdown of all of the fuel burner equipment 20, 21, 22, 23 and 24. The device goes to the zero point and recycles to restart the burner in a normal safe sequence without the lockout switch LOS operating.

In the event that the blower 17 should fail or some blockage should occur eliminating the air flow, the air flow switch 15 opens. If the switch 15 opens, the relay 3K drops out and causes an immediate shutdown of all of the loads 20 through 24 and the device will either recycle in a normal fashion with a safe start or will cause itself to shutdown with the lockout heater LO becoming hot enough to operate the lockout switch LOS. In the event that the lockout switch LOS operates, the system will not operate and an alarm can be sounded requiring manual attention and reset of the system.

Two different types of flame failure can occur as abnormal conditions and the system will accommodate for these failures and shut down in a safe manner. A flame failure at any time between the 30 second and 65 second interval of the timing sequence causes a shutdown of the system by operation of the lockout switch LOS thereby requiring a manual restart after the problem has been corrected. A flame failure after 65 seconds causes a shutdown by means of the postpurge pilot range becoming inactive. The device 10 then goes to the zero time interval and recycles without the supervision or intervention of a human because the lockout switch LOS has not operated.

In the event that any of the limits 14 or starting interlocks 16 operate, power is removed from the 1K control relay and this causes an immediate shutdown of all of the loads 20 through 24 and the recycling of the device from the zero point in time.

It can thus be seen that a unique fuel burner sequencing means 10 has been provided which accomplishes a postpurge pilot effective range burnoff of any possible residual fuel in a burner substantially from the time the main fuel valve 24 opens. The burning off of the fuel in a safe manner protects the process being heated by the burner in a manner which cannot cause any damage to the processed goods, or an explosion by allowing fuel to accumulate in the burner in an unsafe manner. A preferred sequence has been disclosed in great detail and this sequence is capable of being altered by changing the timings of the cam operated switch means or the interaction of one or more of the relays. These changes are all well within the knowledge of one skilled in the art and the present invention is to be limited solely by the scope of the appended claims.

The embodiments of the invention in which an exclusive property or right is claimed are defined as follows:

1. A fuel burner sequencing means for controlling a fuel burner in response to a controller and which includes a pilot burner that is temporarily kept burning after a main burner is turned off thereby insuring complete combustion of fuel, including: motor operated cam controlled switch means and relay operated switch means; flame sensor and amplifier means controlling a portion of said relay operated switch means in response to a flame at said burners; said sequencing means responsive to said controller to provide a prepurge and a normal fuel burner ignition cycle to establish a flame at said main burner with said flame monitored by said flame sensor and amplifier means; said sequencing means including safety lockout means operable to stop said sequencing means and turn off fuel to said burners in the event said flame sensor and amplifier means fails to sense a flame at said burners; and said sequencing means further responsive to a termination sequence of operation of said fuel burner to initiate a postpurge pilot mode of operation whereby said pilot burner is provided with fuel prior to the termination of a flame at said main burner and wherein said pilot burner is ignited by said main burner; said flame sensor and amplifier means continuing to monitor said pilot burner during said postpurge pilot mode of operation without allowing said safety lockout means to stop said sequencing means while said pilot burner burns off any residual fuel from said main burner; said pilot burner being deenergized by said cam controlled switch means and said relay operated switch means to prepare the fuel burner for a subsequent cycle.

2. A fuel burner sequencing means as described in claim 1 wherein said motor operated cam controlled switch means includes a motor rotating a plurality of individual cams to operate switch means associated with each of said cams.

3. A fuel burner sequencing means as described in claim 2 wherein said relay operated switch means includes a control relay which initiates the burner sequencing means in response to said controller; a flame relay which operates in response to said flame sensor and amplifier means, and a load relay which controls electric power to said fuel burner.

4. A fuel burner sequencing means as described in claim 3 wherein postpurge pilot mode of operation is established by said sequencing means operating until said cam operated switch means completes a holding circuit for said load relay to insure energization of said fuel burner, and upon said control relay becoming deenergized.

5. A fuel burner sequencing means as described in claim 4 wherein said flame sensor and amplifier means includes a flame sensor positioned in said fuel burner to respond to a flame at both the pilot burner and said main burner; and said flame sensor and amplifier means further including an amplifier that plugs into said sequencing means and is compatible with said flame sensor.

6. A fuel burner sequencing means as described in claim 1 wherein said flame sensor and amplifier means includes a flame sensor positioned in said fuel burner to respond to a flame at both a pilot burner and said main burner.

7. A fuel burner sequencing means as described in claim 6 wherein said flame sensor and amplifier means includes an amplifier that plugs into said sequencing means and is compatible with said flame sensor.

* * * * *